US009259084B1

(12) United States Patent
Palmer

(10) Patent No.: US 9,259,084 B1
(45) Date of Patent: Feb. 16, 2016

(54) EXPANDABLE CABINET TRAY

(71) Applicant: Jennifer L. Palmer, Beaufort, SC (US)

(72) Inventor: Jennifer L. Palmer, Beaufort, SC (US)

( * ) Notice: Subject to any disclaimer, the term of this patent is extended or adjusted under 35 U.S.C. 154(b) by 223 days.

(21) Appl. No.: 14/056,549

(22) Filed: Oct. 17, 2013

Related U.S. Application Data

(60) Provisional application No. 61/781,890, filed on Mar. 14, 2013.

(51) Int. Cl.
*A47B 77/14* (2006.01)
*A47B 46/00* (2006.01)

(52) U.S. Cl.
CPC ..... *A47B 77/14* (2013.01); *A47B 46/00* (2013.01)

(58) Field of Classification Search
CPC ..... A47B 77/14; A47B 77/16; A47B 45/00; A47B 46/00; A47B 81/04; A47B 88/0407; A47F 3/063; A47F 3/147; A47F 7/0064
USPC ..... 211/41.3, 41.4, 41.5, 41.6
See application file for complete search history.

(56) References Cited

U.S. PATENT DOCUMENTS

| | | | | | |
|---|---|---|---|---|---|
| 3,025,967 | A | * | 3/1962 | Christophersen | 211/41.5 |
| 3,228,739 | A | | 1/1966 | Fay et al. | |
| 3,765,344 | A | * | 10/1973 | Ferdinand et al. | 108/108 |
| 3,971,608 | A | * | 7/1976 | Gans | 312/257.1 |
| 4,482,066 | A | | 11/1984 | Dykstra | |
| 5,016,772 | A | * | 5/1991 | Wilk | 220/8 |
| 5,037,165 | A | | 8/1991 | Rapp et al. | |
| 5,083,848 | A | | 1/1992 | Merino et al. | |
| 5,450,971 | A | * | 9/1995 | Boron et al. | 211/134 |
| 5,645,182 | A | * | 7/1997 | Miller et al. | 211/134 |
| 6,543,069 | B1 | * | 4/2003 | Nelson | 4/656 |
| D490,198 | S | * | 5/2004 | Jerstroem et al. | D32/55 |
| 7,246,711 | B1 | * | 7/2007 | Metcalf | 211/175 |
| 7,806,283 | B2 | * | 10/2010 | Metcalf | 211/175 |
| 8,141,683 | B1 | * | 3/2012 | Wurth et al. | 182/223 |
| 2003/0213759 | A1 | | 11/2003 | Compagnucci | |
| 2005/0040120 | A1 | * | 2/2005 | Pine et al. | 211/41.6 |
| 2005/0200245 | A1 | * | 9/2005 | Reis | 312/205 |
| 2006/0138063 | A1 | | 6/2006 | Johnson | |
| 2008/0169737 | A1 | * | 7/2008 | Shen | 312/205 |
| 2010/0051067 | A1 | * | 3/2010 | Dalsing | 134/46 |
| 2012/0074087 | A1 | * | 3/2012 | Neumann et al. | 211/134 |

FOREIGN PATENT DOCUMENTS

GB 190901546 A * 3/1909

OTHER PUBLICATIONS

Kitchen cabinet dish rack MSK1084. Product listing [online]. OEM, 2012 [retrieved on Sep. 11, 2012]. Retrieved from the Internet:www.alibaba.com/product-gs/459456207/kitchen_cabinet_dish_rack_MSK1084.html.

Kitchen cabinet/dish organizer. Product listing [online]. OLX Inc., 2012 [retrieved on Sep. 11, 2012]. Retrieved from the Internet: http://mandaluyong.olx.com.ph/kitchen-cabinet-dish-organizer-with-cups-glasses-wire-basket-and-plates-saucers-wire-bas-iid-204950681.

* cited by examiner

*Primary Examiner* — Stanton L Krycinski
(74) *Attorney, Agent, or Firm* — Robert C. Montgomery; Montgomery Patent and Design, LP.

(57) ABSTRACT

An expandable cabinet tray comprises a dish securing rack moveably coupled to two (2) rails affixed to an interior portion of a cabinet. The dish securing rack is horizontally adjustable through the use of sliding support rods. Extending upwardly from the dish securing rack are tines for supporting various pieces of dishware.

15 Claims, 5 Drawing Sheets

EXPANDABLE CABINET TRAY

RELATED APPLICATIONS

The present invention was first described in and claims the benefit of U.S. Provisional Application No. 61/781,890, filed Mar. 14, 2013, the entire disclosures of which are incorporated herein by reference.

FIELD OF THE INVENTION

The present invention relates to tray assembly slidably mounted within a cabinet and provided with an expandable assembly and a plurality of tines to support items therein.

BACKGROUND OF THE INVENTION

Today's modern kitchens are provided with an abundance of storage space, but none are used more than the kitchen cabinet. These cabinets are used to store dinnerware such as bowls, plates, and the like, in a stacked format. Additionally, they are used to store cookware such as pots, pans, lids, and the like as well. Unfortunately, this stacked arrangement often means that several items must be removed until the user can get at the one he or she needs. This not only a time-consuming process, but also exposes other pieces of dinnerware or cookware to possible damage from chipping or even breaking. Accordingly, there exists a need for a means by which desired dinnerware and cookware items can be easily removed from a kitchen cabinet, without impacting other items, and without exposing them to possible chipping or damage. The development of the expandable cabinet tray fulfills this need.

The expandable cabinet tray is a storage apparatus for kitchen cabinets that holds various dinnerware and cookware items. The invention is intended to increase usability of the kitchen cabinets as well as prevent damage to the stored items. The invention is comprised of an overall stainless steel frame which fits into the upper wall section of a kitchen cabinet. It is provided with an adjustment mechanism to securely install the invention in place. The frame provides an inner moving mechanism which extends in and out of the cabinet area. In turn, this extension portion includes adjustable dividers for storing each individual piece of dinnerware, such as bowls, plates, cups, or the like. It can also be used to store cookware such as pots, pans, lids, and similar products. As such, at no time does any piece of dinnerware or cookware touch another item. This makes it very easy to remove one item, without having to move other items for access. Additionally, it prevents damage to the item by eliminating the possibility of chipping or breaking. It is envisioned that the present invention could be easily installed in almost any type of kitchen cabinet with a minimal amount of tools, and could be removed at a later date, without leaving any telltale marks behind.

SUMMARY OF THE INVENTION

The expandable cabinet tray is designed with utility and convenience in mind, and is easy to install and use. The tray consists of a primary base plate and an expanding base plate, which are attached to the inside of the cabinets with adhesive pads, such as mastic. This way, no damage to the cabinet would exist. However, if desired, permanent installation could be achieved by using threaded fastening mechanisms.

Base assemblies are preferably stainless steel, and adhesive pads would be placed on the underside of the horizontal portion of each of the primary base plate and expanding base plate. The slide roller bearing on the inside of the primary base plate would allow the expanding base plate to slide out easily.

The tray has a primary frame floor in the form of a stainless steel plate, and support tines are attached to the primary frame floor to hold items vertically. The support tines are stainless steel wires. Disposed along the outside of the support tine assembly of the primary frame, a short distance above the primary frame floor, is a primary frame brace, preferably comprised of stainless steel wire for the purpose of supporting the dishware in the apparatus. The floor of the expansion frame is a series of stainless steel plates, welded to the expanding frame side member of the expanding frame and spaced so as to bypass the support tines attached to the primary frame floor.

In operation, the pull out tray assembly comprising of the primary frame and the extending frame with integral floors and, and support tines may be extended from the cabinet either partially or fully on the slide roller bearings and for the removal or insertion of glassware, dishware, and/or cookware. The items in the tray would be supported on or against the tines on the primary frame floor.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
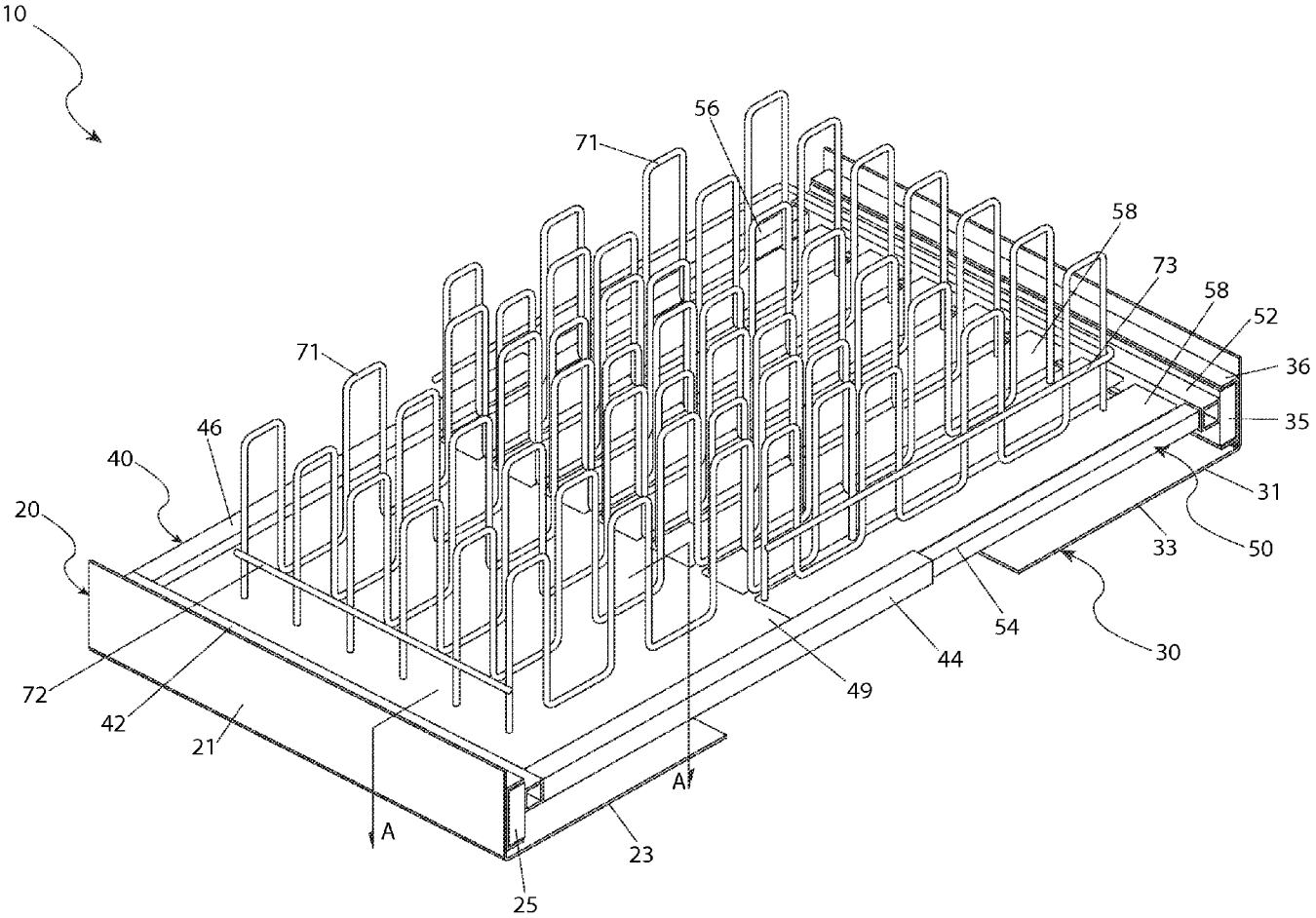
FIG. 1 is an isometric drawing of a cabinet tray 10 in a partially expanded position as it would be installed in a wall cabinet of a width between the minimum and the maximum range, with the tray frame assemblies 40 and 50 entirely retracted on the slide rails 25 and 35 of the base frame assemblies 20 and 30 for the storage of dishware or cookware in the cabinet according to a preferred embodiment of the present invention.

10 cabinet expandable tray
20 primary frame base assembly

21 primary frame base
23 primary frame base adhesive pad
24 removable adhesive protector
25 primary frame slide roller bearing
26 primary frame slide bearing outer race
27 primary frame slide bearing inner race
30 expanding frame base assembly
31 expanding frame base
33 expanding frame base adhesive pad
35 expanding frame slide roller bearing
36 expanding frame slide bearing outer race
37 expanding frame slide bearing inner race
40 primary frame assembly
42 primary frame side member
44 primary frame front member
46 primary frame rear member
49 primary frame floor plate
50 expanding frame assembly
52 expanding frame side member
54 expanding frame front member
56 expanding frame rear member
58 expanding frame floor plate piece
71 support tine assemblies
72 primary frame brace
73 expanding frame brace

DETAILED DESCRIPTION OF THE PREFERRED EMBODIMENT

The best mode for carrying out the invention is presented in terms of its preferred embodiment, herein is depicted in FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a wall cabinet expanding tray (herein described as the apparatus) 10, which provides a means for storing dishware, glassware, and/or cookware in wall cabinets of various standard and custom widths in a manner such that said items can be inserted or removed individually from the tray 10 so as to prevent, or at least minimize, any chipping or breakage of those items that could be caused as a result of the inadvertent handling of them. The preferred embodiment of the apparatus 10 will be to affix the primary base plate 21 and the expanding base plate 31 to the cabinet shelf with adhesive pads 23 and 33, such as mastic, so as to avoid the use of, and eliminate the concurrent damage caused by, other fastening means. However, a more permanent installation could be achieved with the use of threaded fasteners by anyone with minimal skills and access to the necessary tools and hardware and would not be considered outside the scope of this invention.

Referring now to FIG. 1, an isometric view of the apparatus 10, according to the preferred embodiment of the present invention, is disclosed. The apparatus 10 is shown with formed stainless steel base assemblies 20 and 30 attached to a typical wall cabinet shelf through the use of adhesive pads 23 and 33, preferably double-sided mastic, attached respectively to the underside of the horizontal portion of each of the primary base piece 21 and the expanding base piece 31. Attached to the inside of the vertical leg of the primary base piece 21 is an outer race 26 of a slide roller bearing 25. The inner race 27 of the slide roller bearing 25 is affixed to the primary frame side member 42. Similarly, the outer race 36 of another slide roller bearing 35 is attached to the inside of the vertical leg of the expanding frame base piece 31 while the inner race 37 of said slide roller bearing 35 is affixed to the expanding frame side member 52. The purpose of these roller bearing slides 25 and 35 being to provide the means of extending the tray frame out of the cabinet for access to the stored items. This type of slide roller bearing is typically manufactured with an outer race, an inner race, and a sliding race complete with captured ball bearings and has an integral stop mechanism to limit the extension of the races. This preferred embodiment illustrates the use of said slide roller bearings 25 and 35, which are available from several manufacturers, to keep a uniformity of material and application, however, the use of roller wheels and formed slide rails could alternately be used as a means of providing the necessary support and mobility to the apparatus 10 without limiting the scope of this invention.

The front frame member 54 and the rear frame member 56 of the expanding frame 50 fit into the corresponding tubular stainless steel members of the primary frame 40 to provide for expansion or contraction of the apparatus 10 to adjust for installation in wall cabinets of different widths.

The primary frame floor 49 is a stainless steel plate welded to the primary frame rear member 46, the primary frame front member 44, and the primary frame side member 42 of the primary frame 40. Support tines 71 of formed stainless steel wire will be attached to the primary frame floor 49 for the support of items placed in the tray. Disposed along the outside of the support tine 71 assembly of the primary frame 40, a short distance above the primary frame floor 49, is a primary frame brace 72, preferably comprised of stainless steel wire for the purpose of supporting the dishware in the apparatus 10. The floor of the expansion frame 50 is a series of stainless steel plates 58, welded to the expanding frame side member 52 of the expanding frame 50 and spaced so as to bypass the support tines 71 attached to the primary frame floor 49. The free ends of these floor pieces will rest on the solid floor 49 of the primary frame 40 at whatever point the frames are positioned relative to each other and these floor pieces will also be fitted with additional support tines 71 to support dishware or cookware. Disposed along three (3) sides of the support tine 71 assembly of the expanding frame assembly 50, a short distance above the expanding frame floor 59, is an expanding frame brace 73, preferably comprised of a formed stainless steel wire for the purpose of supporting the dishware in the apparatus 10. The frame members of the primary frame 40 and the expanding frame 50 are shown as square stainless steel tubing, however, the utilization of tubing having other cross sections could easily be made without limiting the scope of the apparatus 10.

Figure 2:
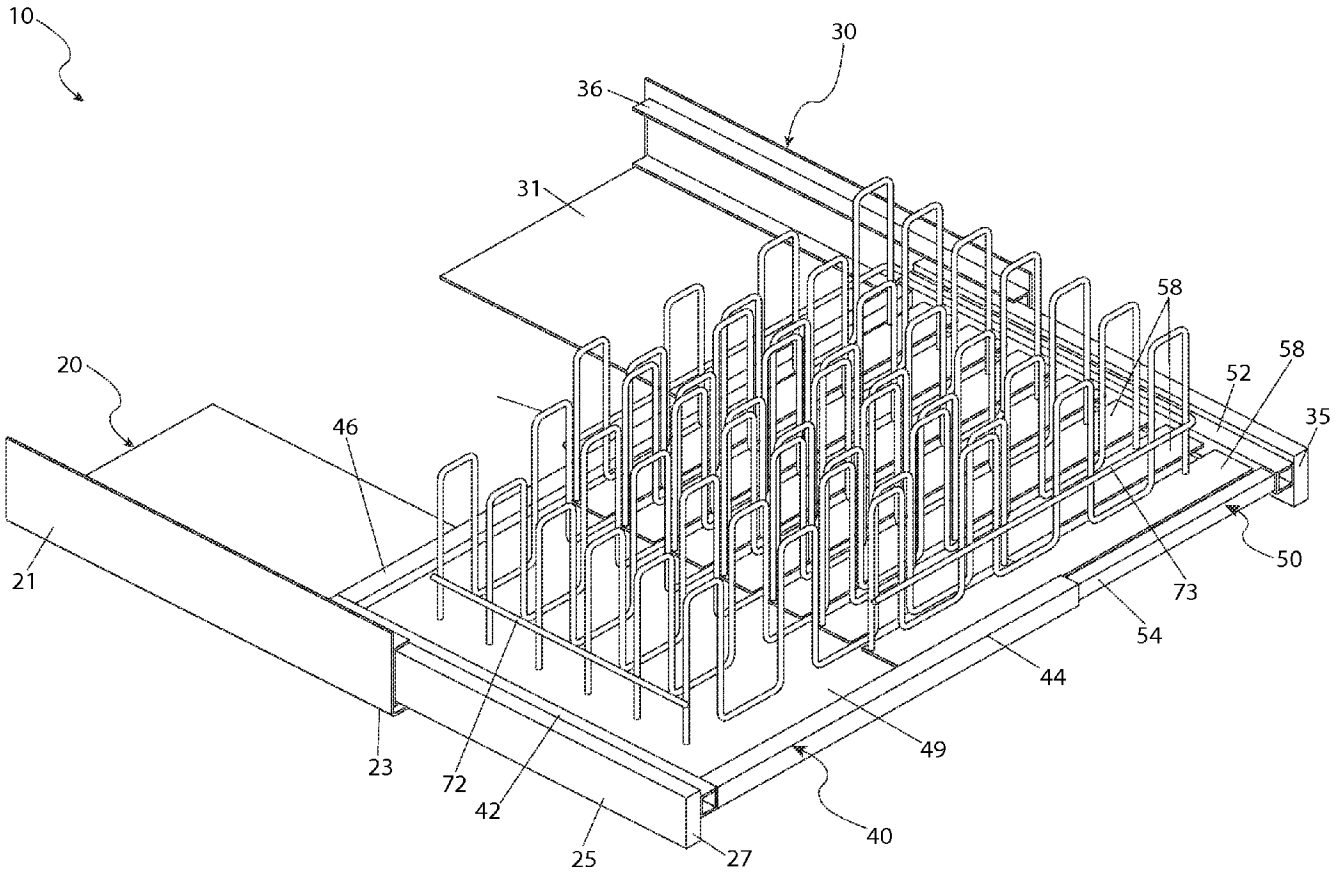
FIG. 2 is an isometric drawing of the cabinet tray 10 in a partially expanded position with the tray frame assemblies 40 and 50 partially extended on the slide rails 25 and 35 of the base frame assemblies 20 and 30 for the removal or insertion of items according to a preferred embodiment of the present invention.

In operation, the pull out tray assembly comprising of the primary frame 40 and the extending frame 50 with integral floors 48 and 58, and support tines 71 may be extended from the cabinet as shown in FIG. 2 either partially or fully on the slide roller bearings 25 and 35 for the removal or insertion of glassware, dishware, and/or cookware. These slide roller bearings 25 and 35 will be sufficient to support the weight of the sliding frame assemblies 40 and 50 with the concurrently stored items The items in the tray 10 will be supported on or against said tines 71 and on the said frame floors.

Figure 3:
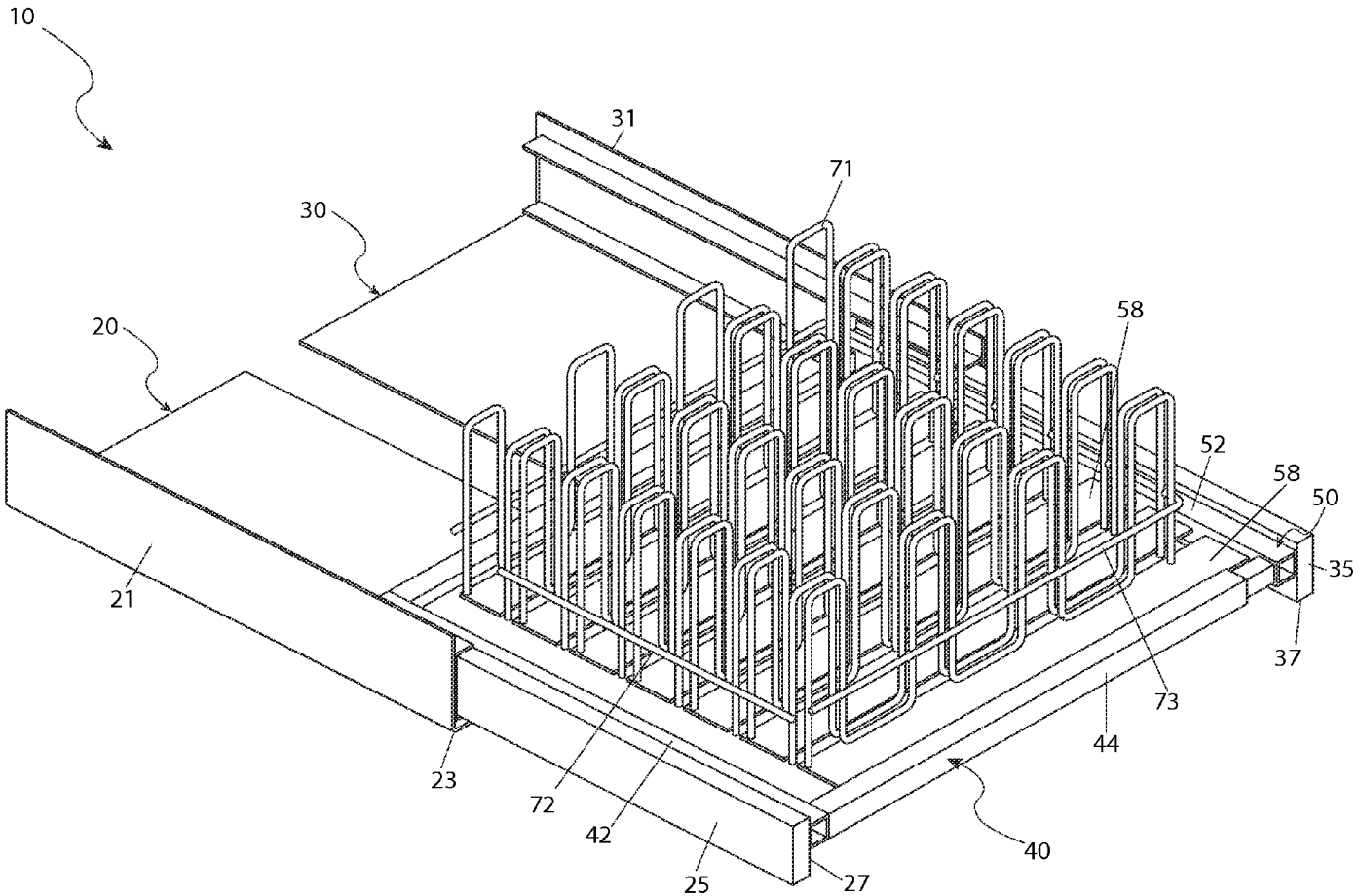
FIG. 3 is an isometric drawing of the cabinet tray 10 in the fully collapsed position, that is with the base frame assemblies 20 and 30 at their nearest proximal position, installed in a wall cabinet of the minimum width with the tray frame assemblies 40 and 50 partially extended on the slide rails 25 and 35 for the insertion or removal of items according to a preferred embodiment of the present invention.

The apparatus 10 will start in the fully collapsed arrangement as shown in FIG. 3 which will be accommodated in the most narrow wall cabinet in the range of sizes for the said apparatus 10. The expanding frame assembly 50 can be adjusted with respect to the primary frame assembly 40 to fit into wider wall cabinets, up to the maximum expandable width, and affixed to the wall cabinet shelf by means of the adhesive pads 25 and 35 on the bottoms of the base pieces 21 and 31.

Figure 4:
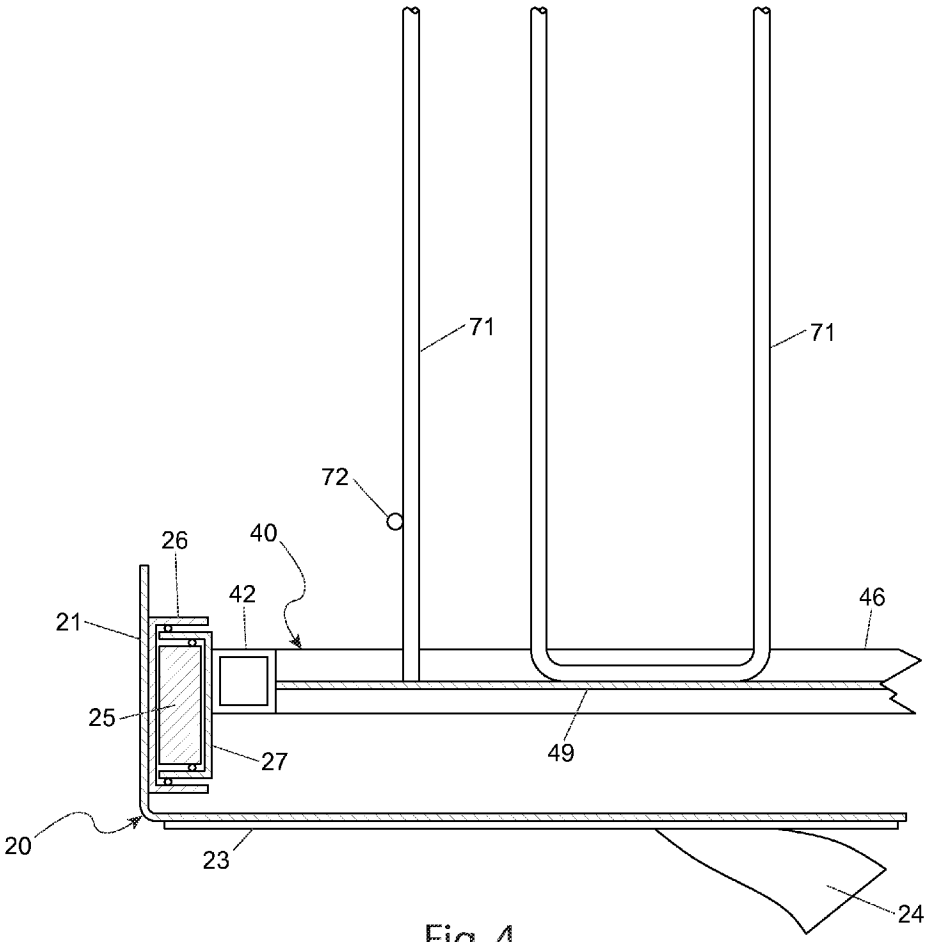
FIG. 4 is a section view along line A-A as shown on FIG. 1 cut through the primary portion of the expandable cabinet tray 10, illustrating the outer race 26 of the slide roller bearing 25 attached to the primary frame base 21, and the inner race 27 of said slide roller bearing 25 attached to the primary frame lower side member 42 of the primary tray frame assembly 40, and with the primary base adhesive pad 23 which will affix the cabinet tray 10 to the shelf of the wall cabinet according to a preferred embodiment of the present invention; and, FIG. 5 is an isometric view of the bottom of the expandable cabinet tray 10 showing the primary frame base adhesive pad 23 and the expanding frame base adhesive pad 33 affixed to the primary frame base 21 and the extending frame base 31 to secure the said base assemblies to the cabinet shelf.

Referring to FIG. 4, a section view cut through the primary base assembly 20 and the primary frame assembly 40, a more illustrative detail of these assemblies can be seen. The primary base adhesive pad 23 can be seen, with a removable adhesive protector 24 attached to the bottom of the horizontal leg of the primary frame base 21. Attached to inside of the vertical leg of the formed stainless steel primary frame base 21 is the outer race 26 of the slide roller bearing 25 which will allow the primary frame assembly 40 to be extended out of the cabinet. The inside bearing race 27 of the slide roller bearing 25 is affixed to the tubular stainless steel primary frame side member 42. The support tines 71 can be seen attached to the stainless steel floor plate 49 of the primary frame assembly 40.

Figure 5:
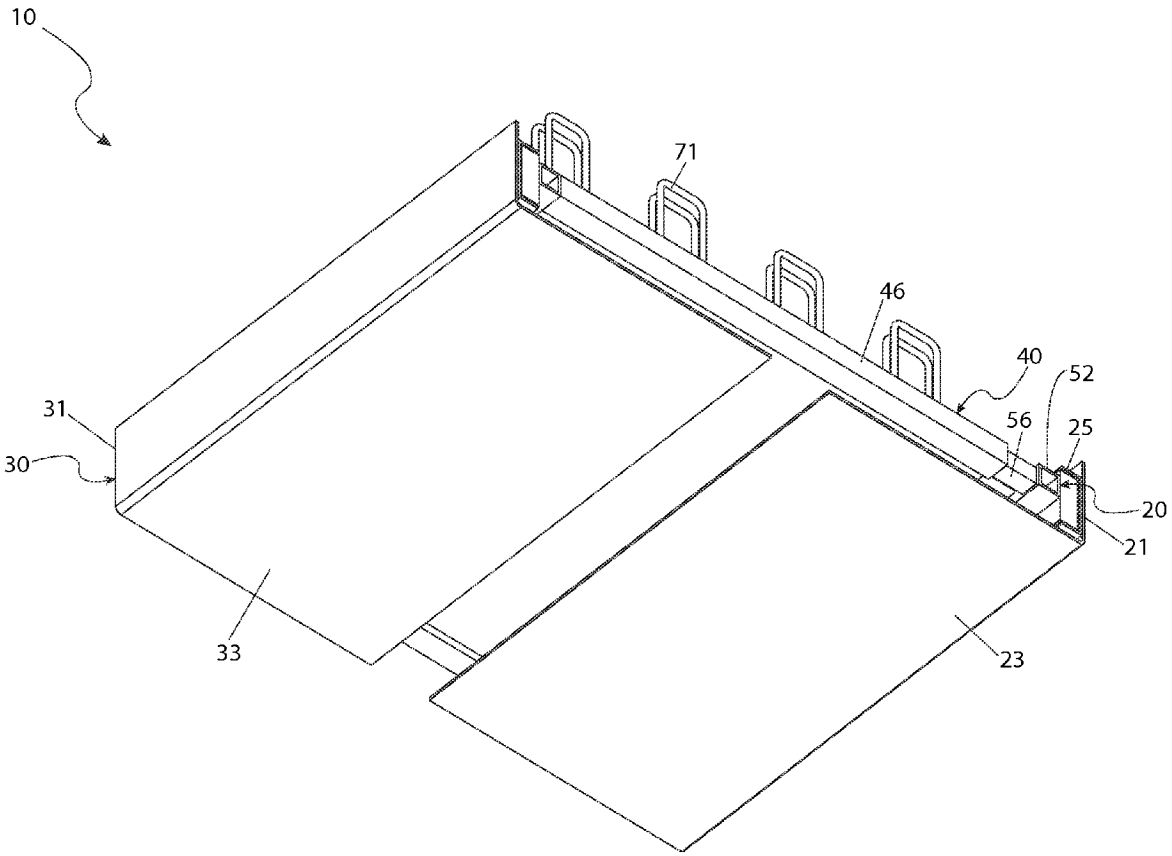

FIG. 5, an isometric view of the bottom of the expandable cabinet tray 10, shows the primary base adhesive pad 23 and the expanding base adhesive pad 33 attached to the bottoms of the horizontal legs of the primary base 21 and the expanding base 31 respectively. This view of the apparatus 10 in the contracted position illustrates the relative size of the adhesive pads 23 and 33 with respect to projected area that said apparatus 20 will occupy on the cabinet shelf.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: acquiring a model of the apparatus 10 having the desired width expansion to properly fit in the desired wall cabinet; assuring that the cabinet shelf comprises a smooth, clean surface; positioning the apparatus 10 in said cabinet observing that the orientation thereof permits the frame assemblies 40 and 50 to be slid out of the cabinet for proper access to the stored items to affect the proper operation of the apparatus 10 with no interference with either the back or the door(s) of the cabinet; adjusting the expansion of the frames 40 and 50 relative to each other to achieve the correct width adjustment allowing for any variation of the cabinet style positions to permit the frames 40 and 40 to slide out of the cabinet with no interferences; marking the locations of the base pieces 21 and 31 on the cabinet shelf; removing the apparatus 10 from the cabinet and pealing off the protective paper covering 24 of the adhesive pads 23 and 33; reinserting the apparatus 10 back into the cabinet to the locations as previously marked on the shelf, being sure to not touch the said adhesive pads 23 and 33 against the shelf until the exact location is achieved; pressing the apparatus 10 firmly against the shelf to assure that is properly affixed to said shelf; and utilizing the apparatus 10 as desired to allow for the insertion, removal, and storage of glassware, dishware, and/or cookware without those items touching each other to prevent incidental contact and resultant damage.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An expandable tray adapted to be mounted within a cabinet interior comprising:

a primary side, comprising:

a primary frame base assembly having a primary frame base plate adapted to be mounted to the left side of said cabinet interior; and, a primary frame assembly having a primary frame floor plate, a primary frame front member, a primary frame rear member, and a primary frame side member wherein said primary frame side member slidingly interconnects said primary frame base assembly to said primary frame assembly such that said primary frame assembly is operable to move in and out of said cabinet while said primary base frame assembly remains fixed;

an expanding side, comprising:

an expanding base frame assembly having an expanding frame base plate adapted to be mounted to the right side of said cabinet interior; and, an expanding frame assembly having an expanding frame floor plate, an expanding frame front member, an expanding frame rear member, and an expanding frame side member wherein said expanding frame side member slidingly interconnects said expanding frame base assembly to said expanding frame assembly such that said expanding frame assembly is operable to move in and out of said cabinet while said expanding base assembly remains fixed;

wherein said expanding frame front member slidingly mounts within said primary frame front member and said expanding frame rear member slidingly mounts within said primary frame rear member such that said expanding side is operable to move to or away from said primary side to change the width of said expandable tray before mounting;

wherein said primary frame floor plate and said expanding frame floor plate each further include a plurality of support tines extending vertically and configured to provide support for any items to be stored thereon;

wherein said expanding frame floor plate is comprised of a plurality of individual lateral floor plates each having a first end affixed to said expanding frame side member and spaced therealong so as to lay on top of said primary frame floor plate and bypass said primary frame floor plate support tines; and, wherein said plurality of individual lateral floor plates comprises said expanding frame floor plate plurality of support tines extending vertically and configured to provide support for any items to be stored thereon.

2. The expandable tray as set forth in claim 1 wherein said primary frame side member further includes a primary frame slide bearing inner race and said primary frame base plate further includes a primary frame slide bearing outer race, and wherein said races have a primary frame slide roller bearing operatively set therebetween.

3. The expandable tray as set forth in claim 1 wherein said expanding frame side member further includes an expanding frame slide bearing inner race and said expanding frame base plate further includes an expanding frame slide bearing outer race, and wherein said races have an expanding frame slide roller bearing operatively set therebetween.

4. The expandable tray as set forth in claim 1 wherein said primary frame floor plate support tines further comprises a support tine brace parallel with said primary frame side member and affixed perpendicularly to the distal ends of said primary frame floor plate support tines.

5. The expandable tray as set forth in claim 1 wherein said expanding frame floor plate support tines further comprises a support tine brace parallel with said expanding frame side member and affixed perpendicularly to the distal ends of said expanding frame floor plate support tines.

6. The expandable tray as set forth in claim 1 wherein said primary frame base plate further includes a double sided adhesive pad that is operable to secure said primary frame base plate to said cabinet interior.

7. The expandable tray as set forth in claim 1 wherein said expanding frame base plate further includes a double sided adhesive pad operable to secure said expanding frame base plate to said cabinet interior.

8. The expandable tray as set forth in claim 1 wherein said primary side and said expanding side are constructed of stainless steel.

9. An expandable tray adapted to be mounted within a cabinet interior comprising:

a primary side comprising:

a primary frame base assembly having a primary frame base plate and a primary frame slide bearing outer race; and, a primary frame assembly having a primary frame floor plate, a primary frame side member, a primary frame slide bearing inner race, and a roller bearing disposed between said primary frame slide bearing outer race and said primary frame slide bearing inner race wherein said primary frame assembly slidingly interconnects to said primary frame base assembly such that said primary frame assembly is operable to move in and out of said cabinet interior while said primary base frame assembly remains fixed;

an expanding side comprising:

an expanding frame base assembly having an expanding frame base plate and an expanding frame slide bearing outer race; and, an expanding frame assembly having an expanding frame floor plate, an expanding frame side member, an expanding frame slide bearing inner race, and a roller bearing disposed between said expanding frame slide bearing outer race and said expanding frame slide bearing inner race wherein said expanding frame assembly slidingly interconnects to said expanding frame base assembly such that said expanding frame assembly is operable to move in and out of said cabinet interior while said expanding base frame assembly remains fixed;

wherein said primary frame floor plate includes a plurality of primary frame floor plate support tines extending vertically and configured to provide support for any items to be stored thereon;

wherein said expanding frame floor plate is comprised of a plurality of individual lateral floor plates each having a first end affixed to said expanding frame side member and spaced there along so as to lay on top of said primary frame floor plate and bypass said primary frame floor plate support tines; and, wherein said plurality of individual lateral floor plates comprises a plurality of expanding frame floor plate support tines extending vertically and configured to provide support for any items to be stored thereon.

10. The expandable tray as set forth in claim 9 wherein said primary frame floor plate support tines further comprises a support tine brace parallel with said primary frame side member and affixed perpendicularly to the distal ends of said primary frame floor plate support tines.

11. The expandable tray as set forth in claim 10 wherein said expanding frame floor plate support tines further comprises a support tine brace parallel with said expanding frame side member and affixed perpendicularly to the distal ends of said expanding frame floor plate support tines.

12. The expandable tray as set forth in claim 11 wherein said primary frame assembly further includes a primary frame front member and a primary frame rear member, and the expanding frame assembly further includes an expanding frame front member and an expanding frame rear member, wherein said expanding frame front member is slidingly mounted within said primary frame front member and said expanding frame rear member is slidingly mounted within said primary frame rear member such that said expanding side is operable to move to or away from said primary side to change the width of said expandable tray before mounting.

13. The expandable tray as set forth in claim 9 wherein said primary frame base plate further includes a double sided adhesive pad that is operable to secure said primary frame base plate to said cabinet interior.

14. The expandable tray as set forth in claim 9 wherein said expanding frame base plate further includes a double sided adhesive pad operable to secure said expanding frame base plate to said cabinet interior.

15. An expandable tray adapted to be mounted within a cabinet interior comprising:

a primary side comprising:

a primary frame base assembly having a primary frame base plate and a primary frame slide bearing outer race; and, a primary frame assembly having a primary frame floor plate, a primary frame side member, a primary frame slide bearing inner race, and a roller bearing disposed between said primary frame slide bearing outer race and said primary frame slide bearing inner race wherein said primary frame assembly slidingly interconnects to said primary frame base assembly and said primary frame assembly is operable to move in and out of said cabinet while said primary base frame assembly remains fixed;

an expanding side comprising:

an expanding frame base assembly having an expanding frame base plate and an expanding frame slide bearing outer race; and, an expanding frame assembly having a plurality of expanding frame floor plates, an expanding frame side member, and an expanding frame slide bearing inner race, and a roller bearing disposed between said expanding frame slide bearing outer race and said expanding frame slide bearing inner race such that said expanding frame assembly slidingly interconnects to said expanding frame base assembly wherein said expanding frame assembly is operable to move in and out of said cabinet while said expanding base frame assembly remains fixed;

said primary frame assembly further includes a primary frame front member and a primary frame rear member, and said expanding frame assembly further includes an expanding frame front member and an expanding frame rear member, wherein said expanding frame front member slidingly mounts within said primary frame front member and said expanding frame rear member slidingly mounts within said primary frame rear member such that said expanding side is operable to move to or away from said primary side to change the width of said expandable tray prior to mounting to said cabinet interior;

said primary frame floor plate and said plurality of expanding frame floor plates each further include a plurality of support tines extending vertically and configured to provide support for any items to be stored thereon;

said plurality of primary frame floor plate support tines and said plurality of extending frame floor plate support tines each further include a support tine brace that is set in parallel with said primary frame side member and said extending frame side member respectively, said support tine braces affixed perpendicularly to the distal ends of said support tines;

wherein said plurality of expanding frame lateral floor plates each has a first end affixed to said expanding frame side member and spaced there along so as to lay on top of said primary frame floor plate and bypass said primary frame floor plate support tines.

* * * * *